US005888178A

United States Patent [19]

Welsh, Jr.

[11] Patent Number: 5,888,178

[45] Date of Patent: Mar. 30, 1999

[54] INFANT WALKER EXTENDER

[76] Inventor: Thomas J. Welsh, Jr., 1412 Shaw Ave., Naperville, Ill. 60564

[21] Appl. No.: 870,915

[22] Filed: Jun. 6, 1997

[51] Int. Cl.[6] ..... B60R 19/42

[52] U.S. Cl. ..... 482/66; 280/87.051; 280/755; 482/68

[58] Field of Search ..... 482/68, 69; 280/87.051; 135/67, 912; 297/5

[56] References Cited

U.S. PATENT DOCUMENTS

| | | | |
|---|---|---|---|
| 1,463,820 | 8/1923 | Humphreville | 482/68 |
| 2,278,901 | 4/1942 | Smock | 482/67 |
| 3,183,028 | 5/1965 | Williams | 482/68 |
| 4,988,138 | 1/1991 | Dana et al. | 135/67 |
| 5,449,185 | 9/1995 | Sykes | 280/87.051 |

*Primary Examiner*—Jerome W. Donnelly
*Attorney, Agent, or Firm*—Marshall, O'Toole, Gerstein, Murray & Borun

[57] ABSTRACT

An extender unit for an infant walker in which the unit is adapted to extend laterally outwardly away from the walker base. The unit is formed of a plurality of extender segments which can be releasably locked to each other and to the walker base by wheel inserts having one-way locks. Wheel assemblies are inserted into the wheel posts on the extender unit. The extender segments, wheel posts, and wheel assemblies can be shipped separate from the infant walker and assembled to the walker at a use site. The walker device cannot be used by an infant without the extender unit because all wheel assemblies are mounted in the extender unit.

27 Claims, 6 Drawing Sheets

FIG. 8
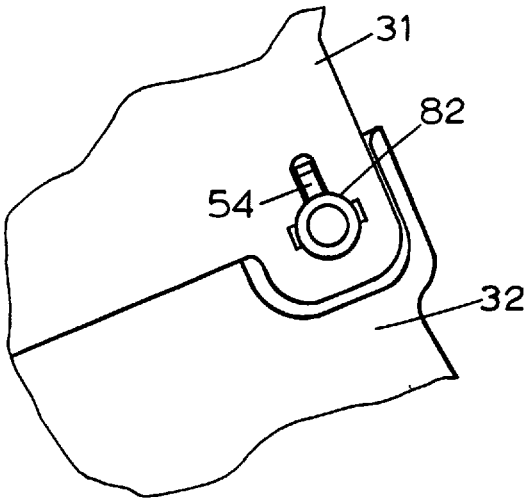
FIG. 9
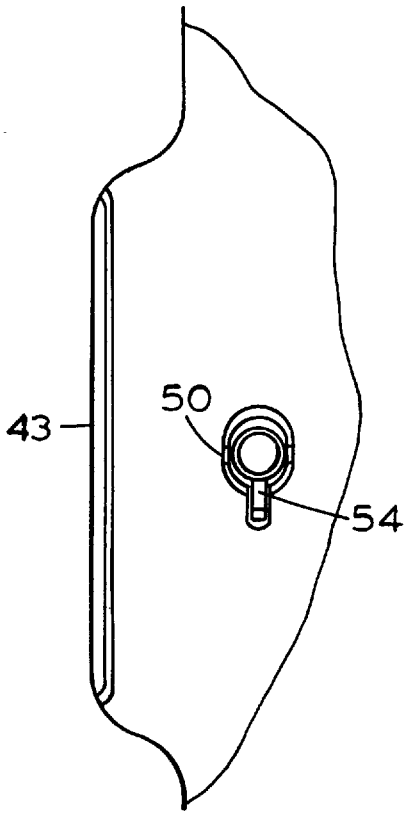
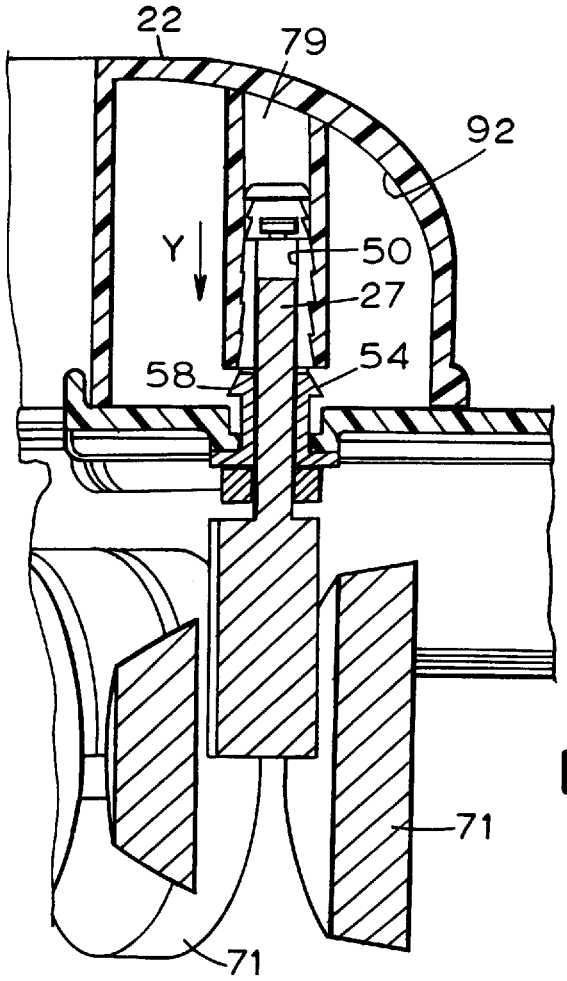
FIG. 10

FIG. 11
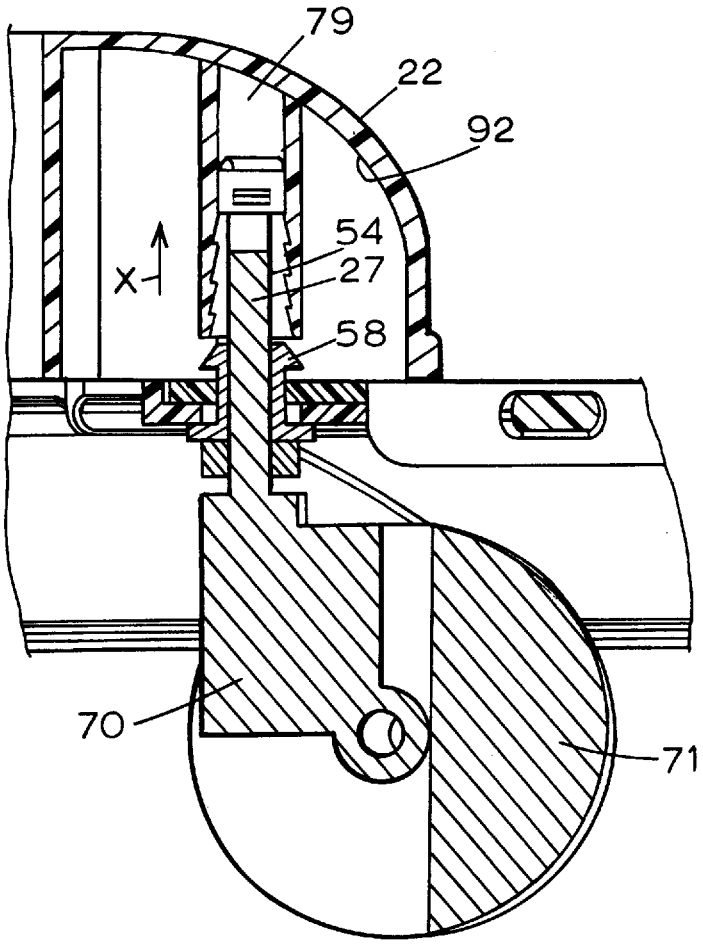
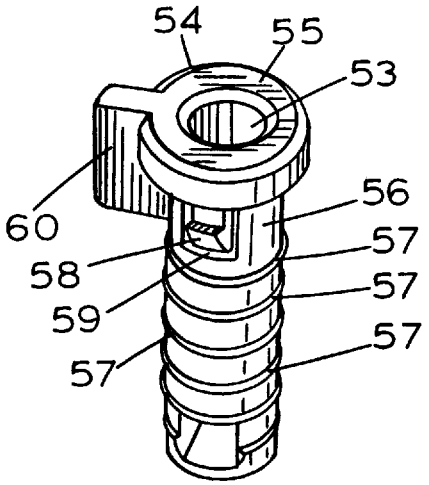
FIG. 12

INFANT WALKER EXTENDER

BACKGROUND OF THE INVENTION

The invention disclosed and claimed herein relates generally to a new and improved infant walker and a kit for use with an infant walker; and, more particularly, the invention relates to an infant walker having an extender unit attached to the walker base.

DESCRIPTION OF PRIOR ART

Infant walkers are well known in the art. They generally include an infant seat and tray mounted on a collapsible pair of intersecting legs. The legs, in turn, are mounted to a walker base, the walker base being disposed on a plurality of rotatable wheels. An infant seated in the walker is able, by pushing his or her feet along the floor, to move the walker in any number of directions. Unfortunately, walkers presently available can be manipulated by an infant to pass through a doorway into a room or an area, such as stairs, where the flooring or surface is uneven or non-existent such that the walker and infant can tip over due to the non-uniform terrain.

Recently, because of concerns about the ability of an infant in a walker to manipulate the walker to a potentially dangerous terrain such as a stairway, standards have been invoked which will require that walker devices be designed so that they are unable to pass through a doorway having a width of thirty-six (36) inches or less.

Accordingly, what is desired is to obviate the ability of an infant, who is located in a walker, from transporting the walker from a room or area where the operation of the walker can be conducted safely and with minimal risk of tipping the device. It is particularly desired that an infant in a walker be precluded from moving the walker from one confined room or area to another room or area where the safe operation of the walker would be impaired. Further, it is desired to have a walker unit which will satisfy the above-discussed standards presently being enacted.

SUMMARY OF THE INVENTION

The invention disclosed and claimed herein serves to obviate the problems associated with infant walkers presently available, while at the same time achieving the desired features for an infant walker.

Briefly, the infant walker of the present invention includes a walker having an extender unit which projects laterally outwardly away from the walker base. The extender unit provides an increased walker width which is greater than the width of a normal 36 inch doorway whereby a child seated or standing in the walker is precluded from transporting the walker through the doorway of a room to an area or terrain where the walker operation cannot safely be carried out. Moreover, the walker extender of the present invention will satisfy standards being enacted which are directed to the overall walker width and it is adapted for use with conventional walkers.

The present invention includes the use of a plurality of walker extender segments which can be assembled to a conventional walker to increase the overall width of the walker base. The segments can be made in component size so that they can be offered and shipped as a kit for assembly to conventional walker units presently available. Similarly, by forming the extender unit in segments which later are assembled at a point of walker use, the overall walker size has not been increased which is significant in not increasing the bulk size of the walker which can adversely affect shipping and storage costs.

Further, once the walker extender segments are assembled to a walker by a retailer or end user, the extender will not be removed from the walker during normal use; however, an end user such as a parent may remove the extender from the walker base and the extender segments from one another for purposes of storage or transportation.

The walker extender of the present invention preferably comprises a plurality of four segments. Each segment includes one or more flanges which assist in connecting the segment to a walker base. Additionally, one end of each segment includes a locking tab while the opposite segment end includes a recess for receiving a lock tab of an adjacent segment. One end of each segment also includes a plurality of locking lugs while the opposite end includes a plurality of slots adapted to receive the lugs located on an adjacent segment.

Upon assembly of the extender device to a walker, each segment is attached to adjacent segments and to the walker base whereby the lugs and tab of one base are inserted in corresponding slots and recesses of an adjacent segment and the flanges of the walker segments are positioned adjacent a walker base wall surface. Wheel posts having one-way locks are inserted in post openings located in the extender segments. The wheel posts lock the extender segments to one another at the location of the tab/recess connections and also lock the segments to the walker base. Conventional walker wheel members are inserted in the wheel posts.

Once assembled, the walker segments serve to increase the overall walker width to a dimension which will satisfy the above-referenced standard whereby the walker cannot be transported by an infant through a doorway of a room or area where it is desired the walker be maintained.

If desired, the walker and extender unit can be disassembled in that the wheel posts can be removed from the walker base and the extender segments are separable from one another.

Finally, with the extender of the present invention, the wheel members, which permit the walker to travel over the terrain, are located only on the extender unit. Thus, the walker device cannot operate without having the extender unit attached to it.

BRIEF DESCRIPTION OF THE DRAWINGS

FIG. 8 shows a fragmentary plan view of an extender segment tab disposed in an extender segment recess;

FIG. 9 shows a fragmentary plan view of an extender segment at the location of a walker post which is contiguous to a segment flange;

FIG. 10 shows a cross-section view taken along lines 10—10 in FIG. 2 and further includes a conventional walker wheel assembly including a stem disposed in a wheel post;

FIG. 11 shows a cross-section view taken along lines 11—11 in FIG. 2 and further includes a conventional walker wheel assembly including a stem disposed in a wheel post; and, FIG. 12 shows a perspective view of a wheel post prior to insertion in a wheel post opening.

DETAILED DESCRIPTION

Figure 1:
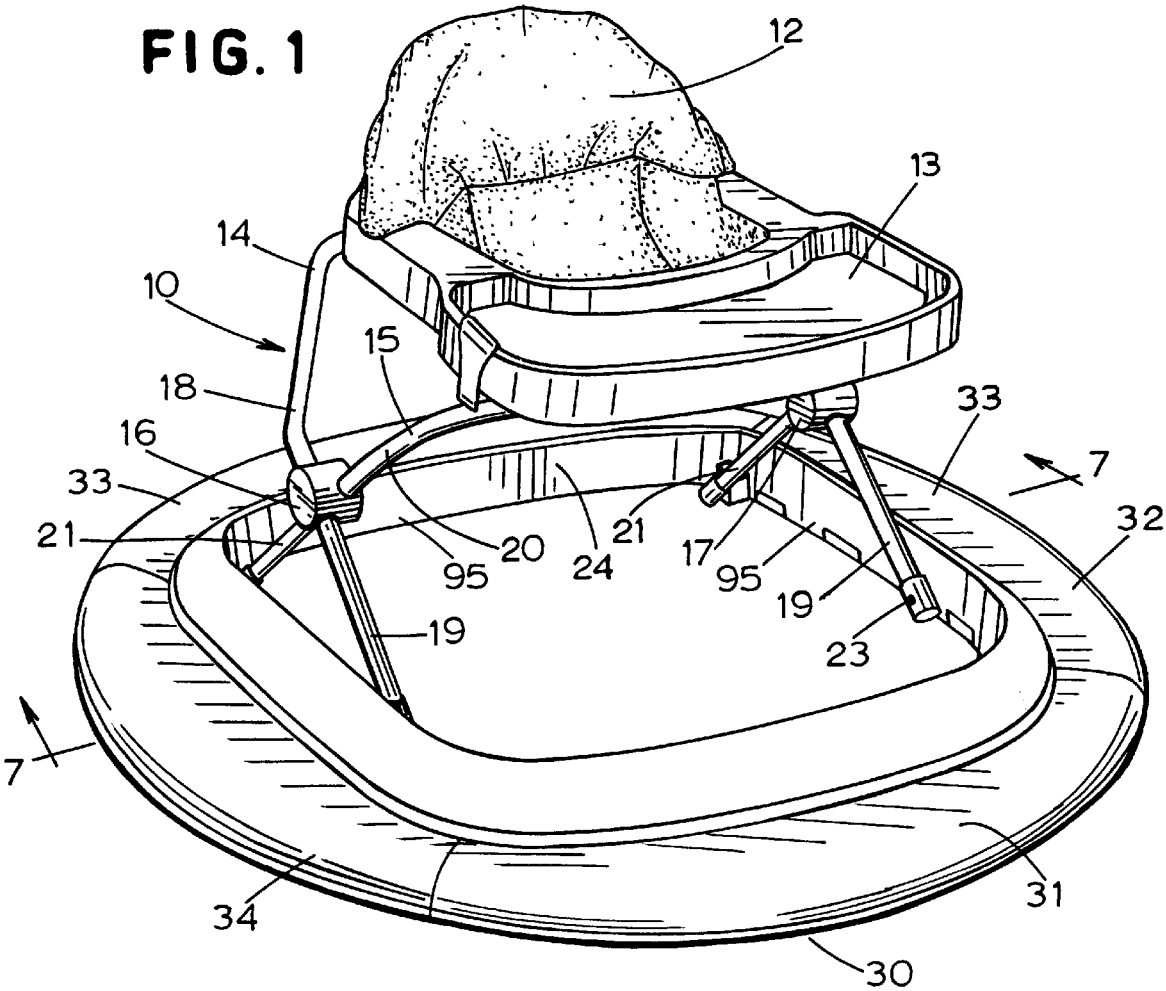
FIG. 1 shows a perspective view of an infant walker having an extender unit base of the present invention mounted to a walker base.

Referring to the drawings and more particularly FIG. 1, infant walker 10 is a conventional device and includes infant seat 12 in which an infant can be disposed to sit or stand. Tray 13 is adapted to be inserted over spaced arms on the infant seat for the purpose of restraining an infant within the seat while at the same time providing a surface upon which various items such as toys can be placed for the amusement of an infant.

The infant seat and tray are mounted on a pair of intersecting U-shaped support members 14, 15 each of which is pivotally connected to a pair of pivot joints 16, 17. Support member 14 includes legs 18, 19 while support member 15 includes legs 20, 21. Legs 18, 19, 20, 21 are either pivotally or fixedly connected to walker base 22 by rivets or other suitable fasteners. As illustrated in FIG. 1, rivets 23 fix legs 18, 19, 20, 21 to inner side wall 24 of walker base frame 22. Walker base 22 generally comprises a molded rectangular or square-shaped frame formed of any suitable polymeric material.

In use, an infant normally is strapped into seat 12. Upon movement of the infant's feet as the infant sits or stands in the walker, walker 10 is adapted to move along a floor or terrain in any desired direction as wheels mounted to rotate 360° contact the floor.

Figure 3:
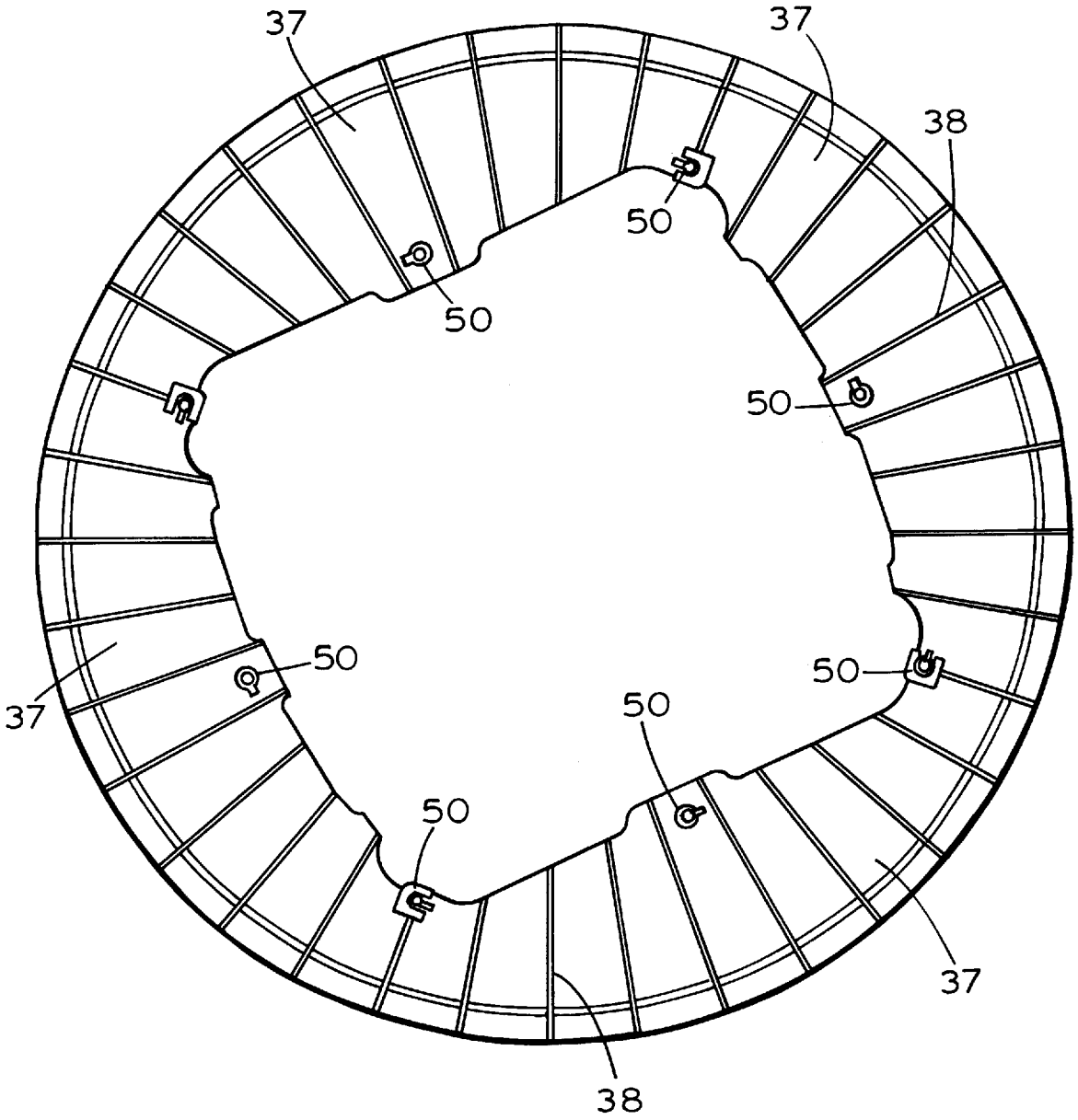
FIG. 3 shows a bottom plan view of the extender unit of FIG. 2.
Figure 4:
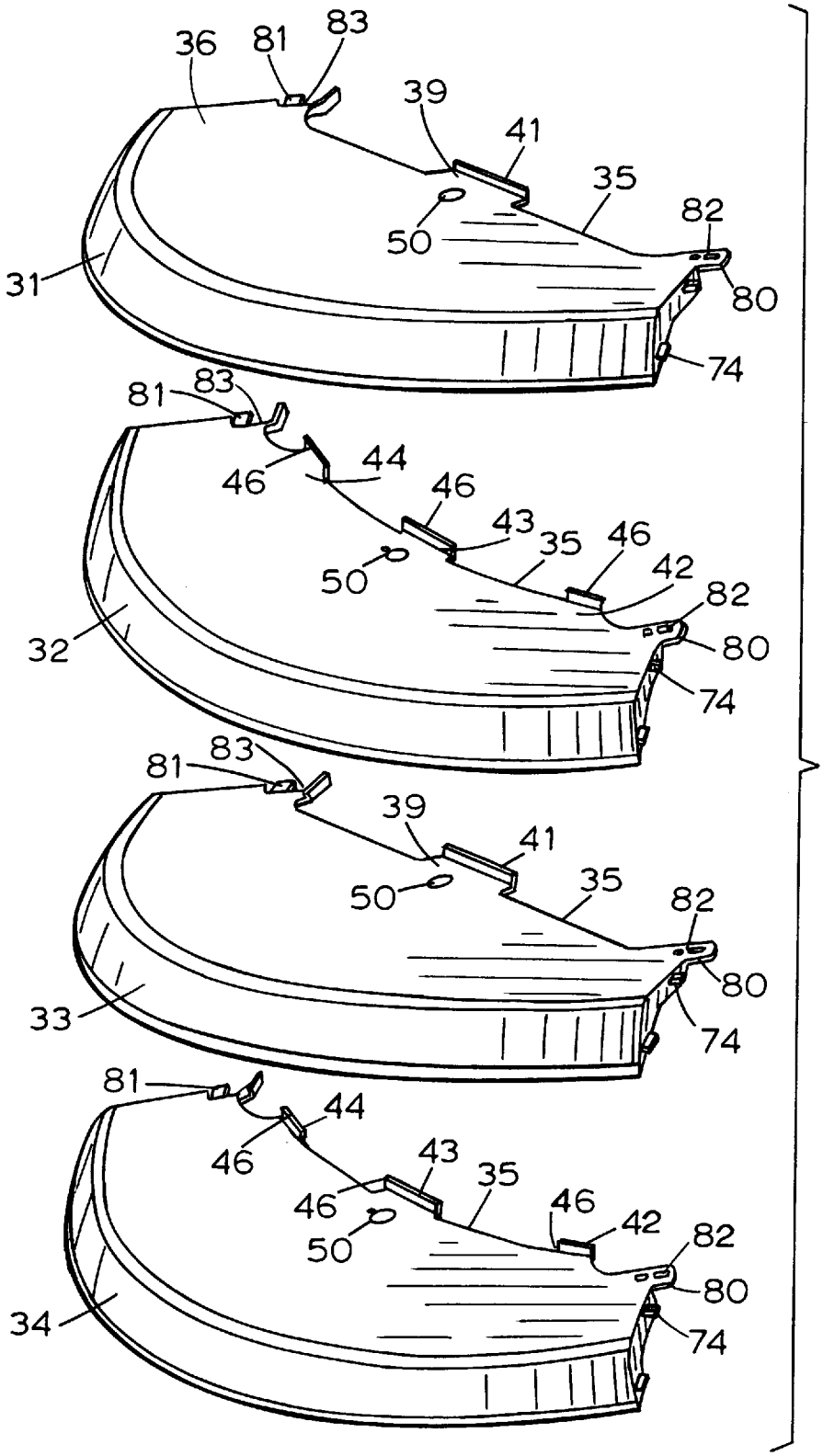
FIG. 4 shows perspective views of four extender segments, which, when assembled, form the extender unit of FIG. 2.
Figure 5:
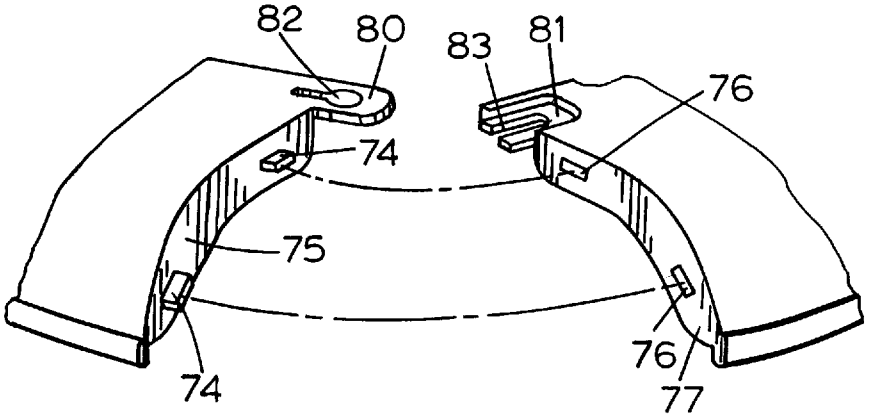
FIG. 5 shows a fragmentary perspective view of two extender segments prior to inserting the lugs and tabs of one segment into corresponding slots and recesses of an adjacent extender segment.

An extender unit 30 is mounted on walker base 22 and extends laterally outwardly from the walker base. Extender unit 30 comprises a plurality of extender unit segments 31, 32, 33, 34 (FIGS. 1 and 4). Each segment preferably comprises a unit molded from a suitable polymeric material having an inner configuration 35 adapted to configure to the corresponding external walker base structure to which the segment is mounted. Each segment includes a top, slightly curved surface 36 which is relatively smooth while the bottom surface 37 (FIG. 3) includes a plurality of spaced stiffening ribs 38. While stiffening ribs have been utilized, it is appreciated that the segment wall thickness could be made thicker obviating the need for any stiffening ribs. The top wall surface terminates in a flanged surface as shown in FIG. 5.

Segments 31 and 33 each include a member 39 having an upturned flange 41. Segments 32, 34 each include spaced members 42, 43, and 44, each having an upwardly turned flange 46.

Each segment includes a plurality of spaced, slotted wheel post openings 50 for receipt of a wheel post 54. Wheel post 54 (e.g., FIG. 12) includes head 55 and depending shaft 56 which is notched at 57 along the length of the outer shaft surface. Biased retaining latches 58 integrally formed in molded latch insert 54 depend from head 55 and are positioned with corresponding openings 59 in insert 54. Key 60 is integral with and extends outwardly from head 55 and shaft 56.

Figure 2:
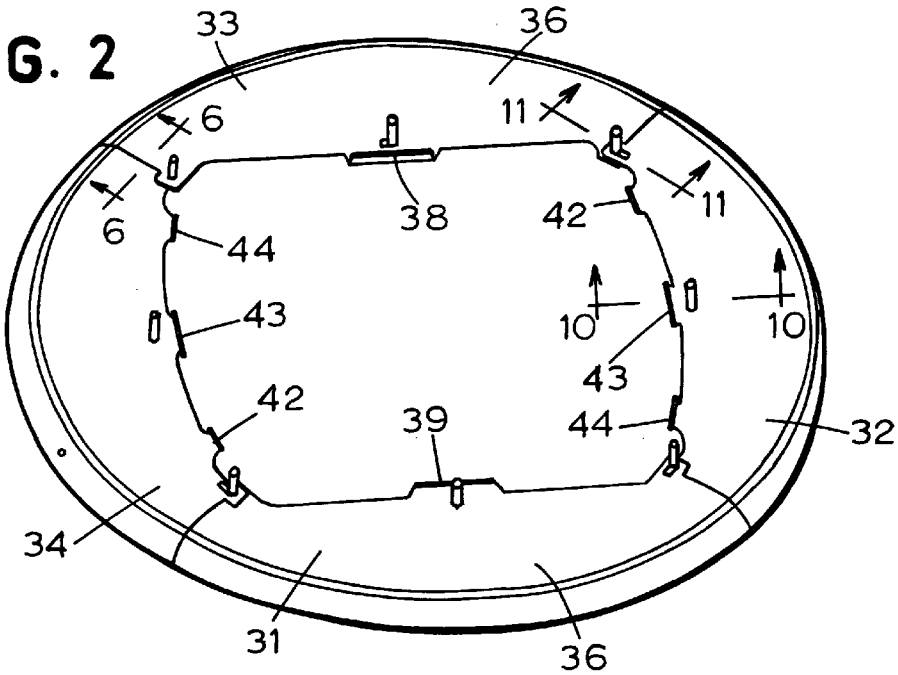
FIG. 2 shows a perspective view of the extender unit of FIG. 1 with the walker including the walker base removed.

A conventional walker wheel assembly 70 having either single or dual wheels 71 is fixed to and rotatable about shaft 27. As partially illustrated in FIGS. 10 and 11, wheel assembly shaft 27 is adapted to be received into wheel post insert opening 50. Upon insertion of posts 54 into openings 50, head 55 seats against the bottom surfaces of a segment and biased retaining latches 58 snap into position adjacent the upper surface of an extender segment whereby an insert 54 is permanently locked into position with shaft 56 extending upward from the top or upper surface of a particular segment as illustrated in FIG. 2. The wheel shafts 27 of wheel assemblies 76 can be inserted in the shaft openings 53 of wheel posts 54.

Turning to FIGS. 2, 7, 10, and 11, it will be observed that when wheel posts 54 are inserted into segment openings 50, the posts also will enter shaft openings 79 formed in and extending outward from the bottom wall surface 92 of walker base 22. Notched portions 57 of post 54 will slidably engage the wall surfaces of the shafts 79 as the posts are inserted in the direction of arrow "X" illustrated in FIG. 11; however, during normal usage of the walker, wheel posts 54 are precluded from moving in the direction of arrow "Y" shown in FIG. 10 because the notches 57 bite and grasp the walker base. As a result, wheel inserts 54 have a one-way lock in the form of notches 57 which permit movement of insert 54 in base 22 in one direction but will not allow movement of the wheel post in the opposite direction during normal usage by an infant or toddler located in the walker. If it is desired, however, to disassemble extender 30 from walker base 22, an end user such as a parent can pull on the extender unit sufficiently to create a force which overcomes the frictional force generated by the notches biting into the walker base, such that the extender unit 30 is removed from walker base 22.

While a conventional wheel assembly has been illustrated, it is appreciated that any form of rollers, such as wheels, which will permit the walker to move about a floor area in all directions are satisfactory for use in the particular application.

Figure 6:
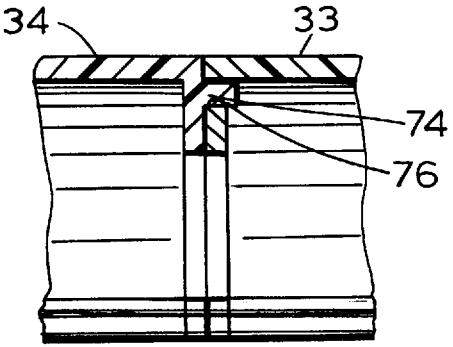
FIG. 6 shows a side cross-section view taken along lines 6—6 in FIG. 2.

The extender segments also each include a plurality of spaced locking lugs 74 located along one segment side wall 75 while a plurality of spaced slots 76 are disposed in a remaining segment side wall 77. As illustrated in FIGS. 5 and 6, locking lugs 74 of one segment are adapted to be inserted in corresponding slots 76 of an adjacent extender segment whereby extender unit 30 can be assembled.

The extender unit segments also each include tab 80 which is adapted to be received in recess 81 of an adjoining extender segment. Tab 80 includes opening 82 while recess 81 includes slotted opening 83, the openings extending to the edge of the segments. When a tab 80 is inserted in a segment recess 81, openings 82, 83 will be axially aligned for receipt of a wheel post 54 whereby the individual segments will be interlocked to one another.

As illustrated in FIGS. 1, 9, and 10, extender 10 has connectors which permit the attachment of an extender 10 to the underside of walker base 22. The notched shafts 56 of the wheel post inserts are locked into base 22 thereby interlocking extender unit 10 to walker base 22 as illustrated in FIG. 1. Shafts 27 of conventional wheel assemblies 70 can be inserted into the shafts of wheel post 54 as illustrated in FIGS. 7, 10, and 11.

When an extender unit 10 is to be assembled at a use site, segments 31–34 are assembled by inserting lugs 74 into slots 76 and tabs 80 into slotted recesses 81 so that the openings 82, 83 in the tabs and recesses are aligned. Wheel posts 54 are inserted through openings 50 in the direction of arrow "X" (FIG. 11) into base shaft openings 79 whereupon extender unit 30 is fixed or locked to base 22 for normal walker use by an infant or toddler and each segment 31–34 is positively interlocked to adjacent extender segments. Viewing FIG. 1, it will be noted, upon assembly, walker base 22 fits snugly over extender unit 10 and covers insert posts 54.

Figure 7:
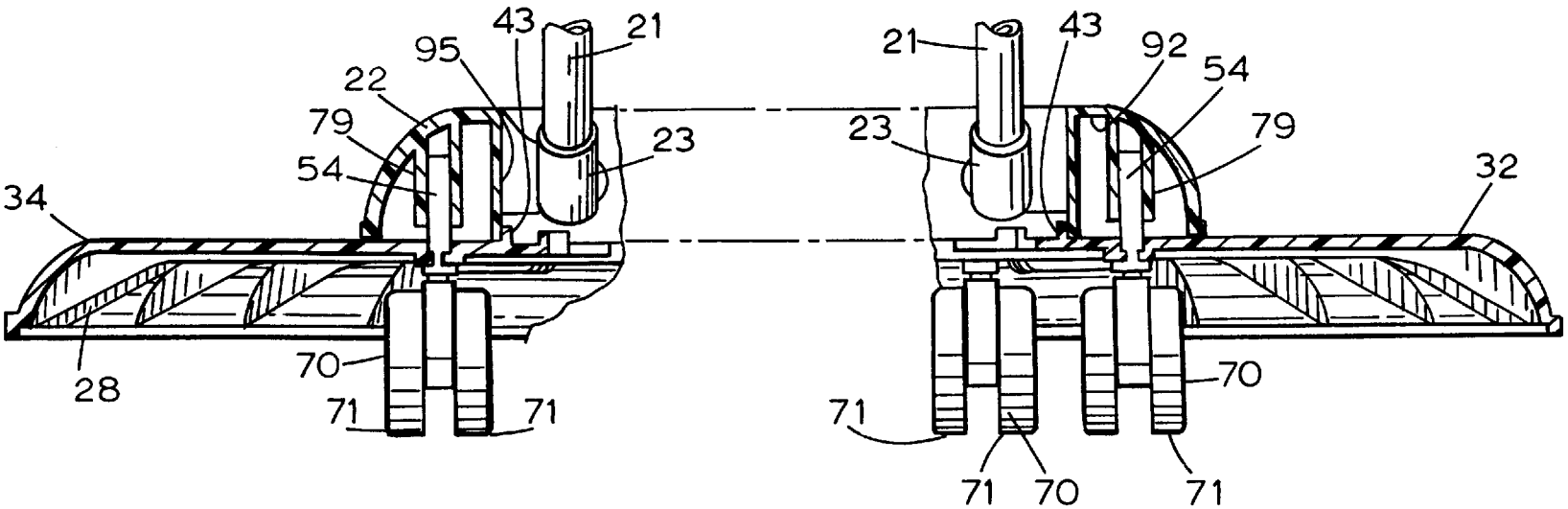
FIG. 7 shows a fragmentary cross-section view taken along lines 7—7 in FIG. 1 with a portion of the walker broken away.

When assembled, extender unit 30 is situated on walker base 22 whereby the inner surface of the upwardly extending flanges 41, 42, 43, and 44 will seat against inner wall surface 95 of walker base 22 (FIG. 7).

When the extender unit is disposed on an infant walker, the overall width of the walker from one extender edge to the opposite edge is at least thirty-six (36) inches or a distance in excess of the width of a conventional doorway opening and will satisfy standards presently being enacted.

When one desires to store or transport the walker, extender unit 30 can be pulled away from walker base 22 by an end user, such as a parent or the like, who can generate a force sufficient to overcome the frictional force generated by the post insert notches grasping the wall surfaces of walker base shafts 79 as a post is pulled relative to base 22 in the direction of arrow "Y" (FIG. 10). With extender unit 30 removed from walker base 22, the extender segments 31–34 can be separated from one another as the segment tab 80 can be pulled out of the U-shaped segment recess 81 of an adjacent segment at the location of slotted opening 83.

When the extender units are disassembled from the walker base, the wheel members will remain in the wheel posts located in the extender segments such that no wheel assemblies 70 are located on walker base 22 and walker device 10, without the extender unit attached to it, will not function as a walker due to the absence of any wheel assemblies.

Wheel assemblies 70 are conventional wheel assemblies utilized with walkers presently available. They include wheel assembly shafts 27 which are adapted to be engageable with shaft opening 53 in a post 54.

The extender unit either can be molded to comprise one member only as opposed to a plurality of extender segments, or, if desired and presently preferred, the extender unit can be in a kit form, the kit preferably comprising four extender unit segments 31, 32, 33, and 34, wheel inserts 54 and wheel assemblies 70. While it is appreciated the extender has been illustrated in four components, it is appreciated that any suitable number of components can be utilized. Similarly, while various lugs, slots, wheel inserts, and wheel assemblies have been illustrated with the various extender unit segments, it is appreciated that one skilled in the art could readily use other combinations of lugs, slots, wheel inserts, and wheels without departing from the spirit and scope of the invention.

Similarly, if desired, the extender unit and wheel inserts can be molded from any suitable polymeric material.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. A kit for use with a walker device which includes a base member and a seat member positioned from said base member into which an infant can be seated, said kit comprising:

a plurality of extender segments adapted to be attached to said base member and extend laterally outward from said base member, each segment including:

first means for locking said segments to each other;

second means for connecting adjacent segments to said base member whereby said extenders extend laterally outwardly from said base member thereby increasing the external periphery of said walker; and means for rolling said walker on a terrain, said rolling means being attached to said extender segments when said kit is assembled.

2. A kit in accordance with claim 1 wherein said first means for connecting said segments to each other includes a plurality of spaced lugs located on one of two ends of a segment and a plurality of spaced lug receiving slots located on the remaining segment end.

3. A kit in accordance with claim 2 wherein said second means includes a tab projecting from one of said segment ends and a tab receiving recess located at the remaining end of said segment.

4. A kit in accordance with claim 3 and further including:

locking means for releasably locking said segments to said base member and for releasably locking adjacent segments to each other.

5. A kit in accordance with claim 4 wherein said locking means comprises a cylindrical post member having a lock disposed on said post member engageable with said base member.

6. A kit in accordance with claim 5 wherein said lock includes a plurality of notches disposed on said insert post whereby said insert post can be inserted in the base member.

7. The method of adding an extender unit kit to an infant walker device which includes a base member spaced from and disposed below an infant seat, and said kit includes a plurality of extender segments, said method comprising:

releasably connecting said extender segments to each other;

orienting said extender units relative to said base member; and interlocking said extender units to the base member whereby said segments extend laterally outwardly from said walker base member thereby increasing the external periphery of said walker device.

8. The method of claim 7 wherein said extender segments are connected to one another by placing a plurality of spaced lugs located in one end of an extender support into a plurality of spaced slots located in an end of an adjacent extender segment to form an extender unit and placing an extender segment tab into a recess of an adjacent extender unit.

9. The method of claim 8 wherein said extender segments are locked to one another at the location of said tab and recess by placing wheel insert posts in openings located in assembled segment tabs and recesses and locking said posts to said base member.

10. The method of claim 9 and further including inserting posts through openings mediate the ends of said segments and locking said posts to said base member.

11. An infant walker having a base member and an infant seat member disposed above said base member, said walker comprising;

a plurality of extender segments configured and dimensioned to extend laterally outwardly from said base member;

each extender segment including first means for releasably connecting adjacent segments to each other and second means for releasably connecting said segments to said base member;

whereby said extender segments, when connected to said base member extend laterally outwardly from said base member to increase the external periphery of said walker.

12. An infant walker in accordance with claim 11 wherein said first means comprises spaced lugs located on one of two extended segment ends and spaced lug receiving slots located on said remaining segment end.

13. An infant walker in accordance with claim 12 wherein said extender segments each include a tab disposed on one end of a segment and a tab receiving recess on said other end of said segment.

14. An infant walker in accordance with claim 13 wherein each of said segment tabs and recesses includes an opening and each of said segments includes at least one opening mediate said segment ends.

15. An infant walker in accordance with claim 14 wherein said lock means includes a plurality of lock members adapted to be inserted in said segment openings and said base member.

16. An infant walker in accordance with claim 15 wherein said base member includes a plurality of openings in the bottom surface of said base with each opening being adapted to receive said lock means.

17. An infant walker in accordance with claim 16 wherein said lock means comprise a cylindrical post having an opening therein and a plurality of spaced notches disposed along the longitudinal axis of said post for frictional engagement with said walker at the location of said base openings.

18. An infant walker in accordance with claim 17 and further including a plurality of wheel assemblies, each assembly having a wheel stem adapted to be received in one of said post openings.

19. An infant walker in accordance with claim 11 wherein said lock means comprises a one-way lock.

20. An infant walker having an infant seat and a base member spaced from and disposed below said infant seat, said walker comprising;

a plurality of extender segments configured and dimensioned to extend laterally outwardly from said base member;

members located on and depending solely from said extender segments for moving said walker relative to a ground surface;

each extender segment including means for releasably connecting adjacent segments to each other; and second means for releasably connecting said segments to said base member whereby said segments connected to said base member serve to increase the external periphery of said walker.

21. An infant walker in accordance with claim 20 wherein said infant walker base member has no wheel members disposed thereon when said extender segments are attached to said base member; and, said walker includes a plurality of wheel assemblies for moving said walker relative to a surface area, said wheel assemblies extending only from said extender segments.

22. The method of claim 7 and further including the step of attaching rollers to said extender units.

23. An infant walker having an infant seat and including a base member disposed below said seat, said walker further comprising:

a plurality of extender segments configured and dimensioned to extend laterally outwardly from said base member; said extender elements being releasably fastened to said base member and adjacent elements being releasably fastened to one another.

24. An infant walker in accordance with claim 23 and further including rollers connected to said extender units.

25. An infant walker in accordance with claim 23 and further including locking means for locking adjacent extender segments to one another to form an extender unit and releasably locking said segments to said base member whereby said extender unit extends laterally outwardly from said base member.

26. An infant walker comprising an infant seat and a base member disposed below said infant seat;

a plurality of extender segments each segment configured and dimensioned to extend laterally outwardly from said base member;

each segment including fastening members for fastening adjacent segments to each other to form an extender unit;

each segment further including connector members for connecting said segments to said base member whereby said extender segments, when assembled to said base member serve to increase the external periphery of said walker device; and inserts disposed on said connectors for locking said segments to said base member whereby said extender unit extends laterally outwardly from said base member.

27. An infant walker as in claims 1, 11, 20, or 26 in which each of said extender segments include a substantially flat portion having an outer edge and a flange portion located at the outer edge of said flat portion.

* * * * *